United States Patent [19]

Courtney

[11] Patent Number: 4,829,600

[45] Date of Patent: May 16, 1989

[54] BASEBALL CAP WITH BUILT-IN GLOVE

[76] Inventor: Marcella J. Courtney, 1131 W. Farnum, Apt. 201, Royal Oak, Mich. 48067

[21] Appl. No.: 120,160

[22] Filed: Nov. 13, 1987

[51] Int. Cl.[4] ..... A41D 13/10; A41D 19/00

[52] U.S. Cl. ..... 2/19; 2/161 A; 2/195; 2/196

[58] Field of Search ..... 2/19, 161 A, 195, 196

[56] References Cited

U.S. PATENT DOCUMENTS 4,541,127 9/1985 Gould ..... 2/19

4,628,543 12/1986 Hunt ..... 2/195 X

*Primary Examiner*—Louis K. Rimrodt

*Attorney, Agent, or Firm*—Harness, Dickey & Pierce

[57] ABSTRACT

A baseball cap has a large flexible web extending across the full cross section of the cap and secured to the band with hand access to the space between the crown of the cap and the web being provided by openings at the rear of the cap both above and below the overlapping head-size adjusting straps whereby the web can serve as a glove for a hand inserted through either one of the openings.

2 Claims, 2 Drawing Sheets

FIG 5
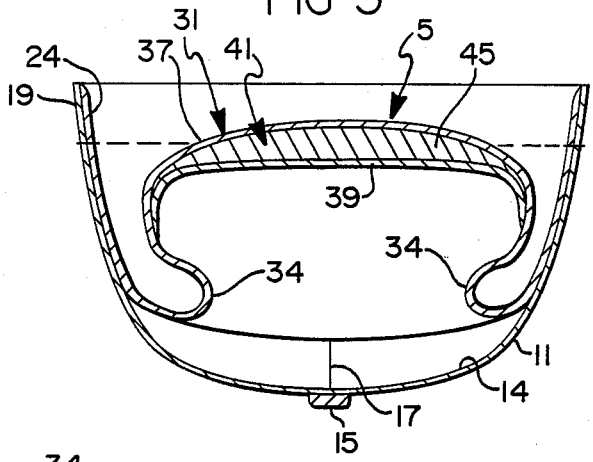
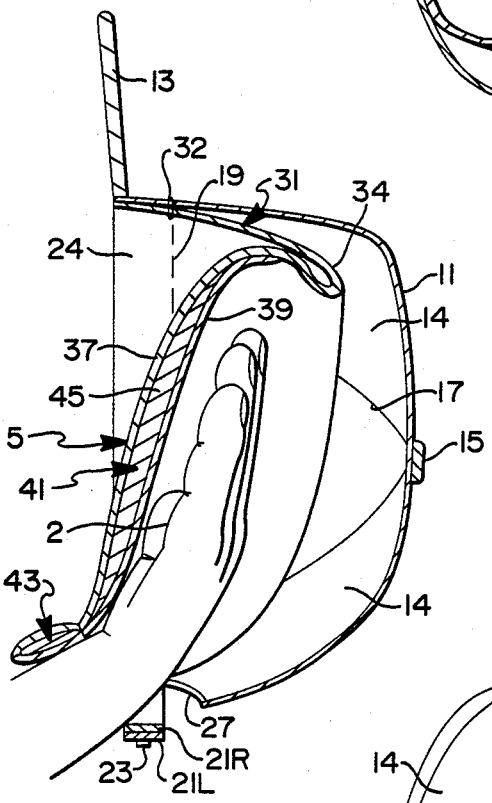
FIG 4
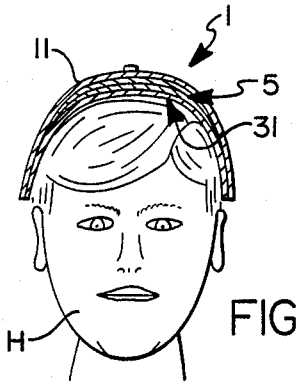
FIG 6
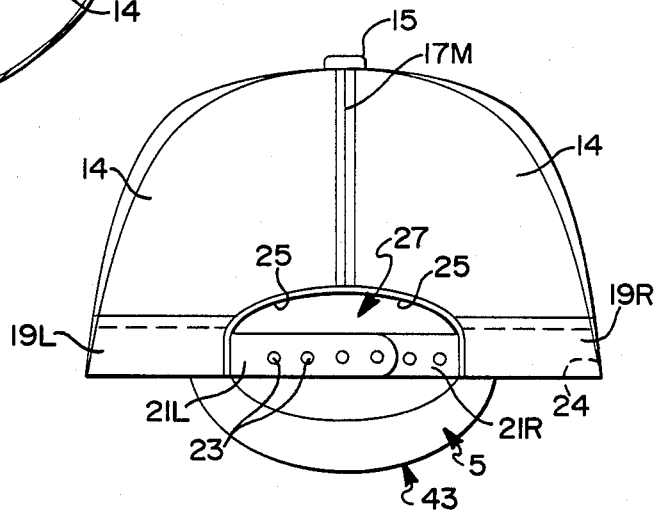
FIG 3

BASEBALL CAP WITH BUILT-IN GLOVE

BACKGROUND OF THE INVENTION

This invention relates generally to headwear and, in particular, to baseball caps. It is one purpose of the invention to provide a modified baseball cap that can be used as a glove to catch baseballs. The cap of this invention is intended especially for baseball fans who can use it to catch foul balls or home runs hit into the stands.

U.S. Pat. Nos. 2,615,168, 4,165,542, 4,312,076, and 4,386,437 all relate to hats or sport caps having pockets in the crown for the storage of small articles such as keys, coins, licenses, etc. U.S. Pat. No. 2,688,204 discloses a helmet containing a fish landing net and U.S. Pat. No. 4,484,363 shows a cap having a pocket containing a coolant. None of these suggest use of headwear as a baseball glove or even as glove means.

In preferred form, the invention uses a baseball cap that is available on the open market. A flexible, fabric web is inserted inside the crown of the cap and suitably secured to the cap body. The web is preferably large enough to serve as a liner for the cap and preferably padded to serve as a baseball glove. The user's hand can be inserted through the usual headsize adjustment opening at the rear of the cap so that it is between the padded portion (where the palm of the user's hand will be) and the upper crown. In this hand position, the cap has been converted into a baseball glove and can be employed by the user to catch a baseball.

DESCRIPTION OF THE DRAWINGS

FIG. 3 is an end elevation taken from the back of a cap such as shown in FIGS. 1 and 2;

FIG. 4 is a cross section along the line 4—4 of FIG. 2;

FIG. 5 is a cross section along the line 5—5 of FIG. 2; and

FIG. 6 is a cross section showing the cap used as a cap.

DETAILED DESCRIPTION OF THE PREFERRED EMBODIMENT

Figure 1:
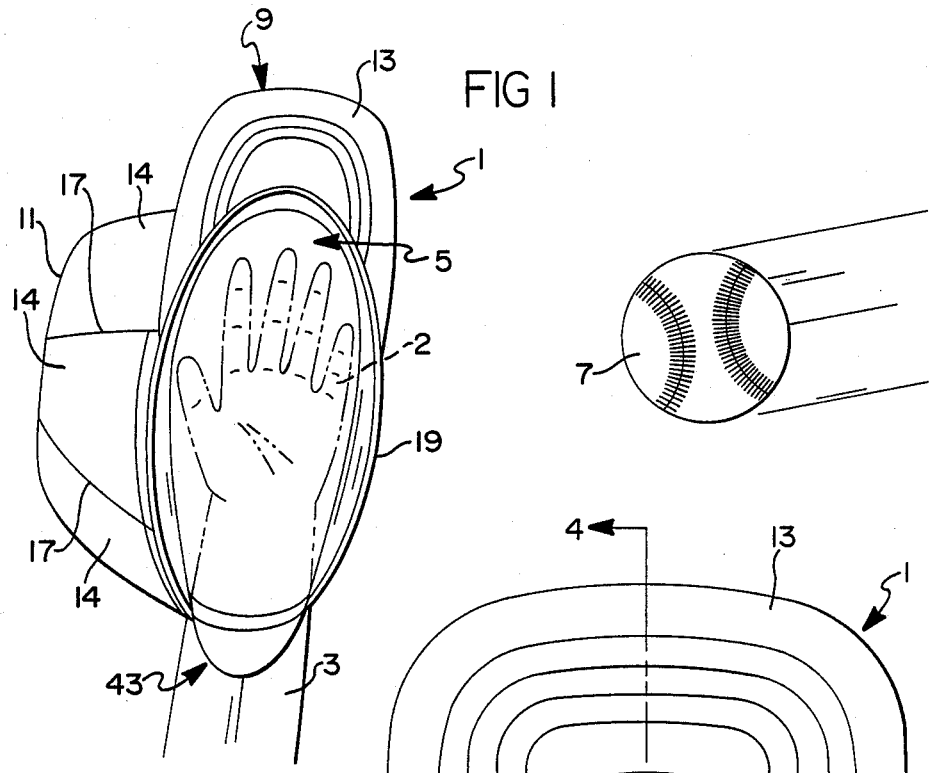
FIG. 1 is a perspective view showing the cap of the invention in use as a glove to catch an approaching baseball.
Figure 2:
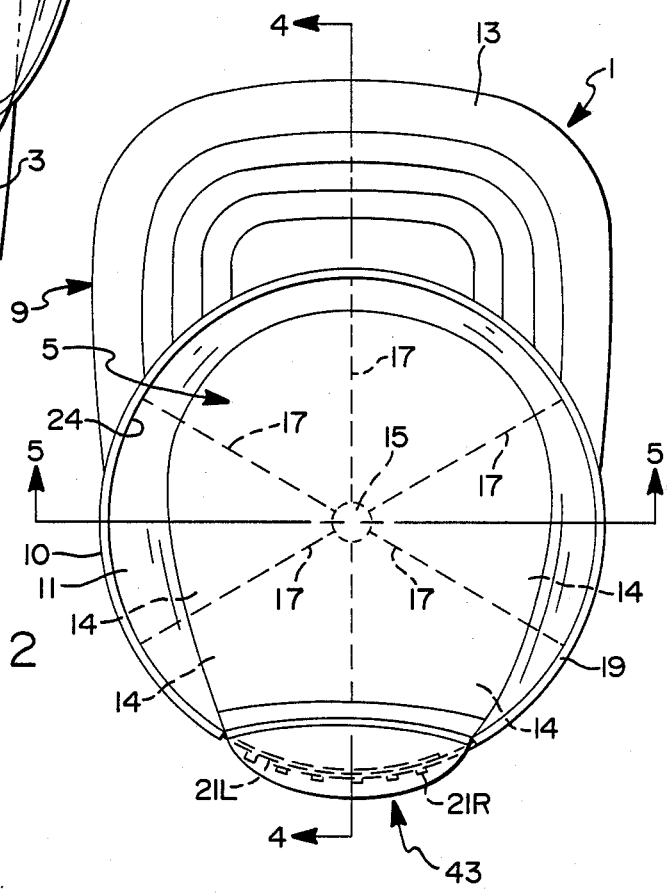
FIG. 2 is a bottom plan view of a baseball cap embodying the invention.

Referring first to FIG. 1, a headwear 1 in accordance with the invention is shown in use as a glove. The user's hand 2 is inside the headwear (in the form of a baseball cap) and the user's arm 3 is extended to align the glove means 5 in the cap with the approaching baseball 7. Thus, the headwear 1 is converted into a baseball glove and FIG. 1 illustrates how it may be used by a baseball fan to catch a foul ball or home run hit into the stands at a baseball game.

As shown in the various Figures, the headwear 1 of the invention preferably uses an ordinary baseball cap 9 available on the open market. This comprises a cap body 10 that has a crown portion 11 to fit over the head of a user and a stiff visor 13 at the front of the cap body. The crown portion 11 is formed from six pie-shaped segments 14 which meet at the top button 15 and are seamed to each other along radial lines 17 extending downwardly from the top button 15. The bottom, wide parts of the segments 14 are secured to the bottom rim band 19. The band 19 is attached at the front of the cap to the visor 13 and has left and right hand portions 19L and 19R, respectively, extending rearwardly from the visor 13 and defining the bottom of the crown portion 11. The cap 9 is of the adjustable headsize type so that in the back the band portions 19L and 19R terminate a substantial distance away from the midplane of the cap as identified by seam line 17M. However, head size adjustment strap members 21L and 21R are securely attached to band portions 19L and 19R, respectively, and extend circumferentially to substantially overlap each other. Suitable connecting means 23, such as pins on one strap member and pin receiving holes on the other, are provided to secure one strap member to the other in the desired position of overlap, thereby determining the headsize of the cap 1. The band 19 and strap members 21L and 21R act together to define the adjustable head receiving opening 24 at the bottom of the cap, i.e., the maximum cross section of crown 11.

Headsize adjustment is customarily facilitated in baseball caps of the type illustrated by foreshortening the inner portions of the two rear crown segments 14 as shown at 25. The effect of this is to provide an opening 27 of substantial size at the rear of the cap. The strap members 21L and 21R extend across this opening and the extent of their overlap determines the width of the opening and the headsize of the cap. The size of opening 27 above the strap member 21L and 21R is, with caps now on the open market, ordinarily large enough to allow the hands of children and many adults to pass through it. Thus, their hands can generally be inserted into the interior of the crown portion 11 of the cap through opening 27. This is generally true even for different size caps because a person's hands and head tend to be proportional in size. The opening 27 can be made larger in a given cap by connecting strap members 21L and 21R together in the minimum overlap position or by leaving then unconnected. It may be noted that the opening 27 is separate from the head opening 24 when the members 21L and 21R are connected.

In the presently preferred embodiment illustrated in the drawings, the glove means 5 includes a flexible web member 31 that extends across the full cross section of the cap and is secured around most of its periphery to the band 19 of the cap body 10. It is not secured to the band or cap body 19 at the rear of the cap in line with hand opening 27. This allows a hand 2 to be inserted into the space between the web member 31 and the top of the crown 11. The web member periphery is secured to the band 19 by sewing, stitching, mechanical fasteners, adhesion, or other suitable means as indicated at 32.

The bottom of the web member 31 is engaged by the user's head when the cap is used as headwear. The web has enough material and slack in it, as shown at 34, so that it will substantially mold itself around the head H of the user and to the inside of the crown 11 of the cap as shown in FIG. 6. Thus, it performs the function of a liner for the crown 11 as well as the function of a glove means.

The web member 31 is preferably a laminated construction formed in part by two layers 37 and 39 of cloth. The palm portion 41 of web member 31, where a ball is likely to be caught, preferably contains a layer of padding 45 between fabric layers 37 and 39 to help protect the user's hand against the sting of a hard ball. As seen best in FIGS. 1 and 4, the web member 31 also preferably includes a padded heel portion 43 that extends out of cap head opening 24 below opening 27 and straps 21L and 21R. Thus, portion 43 covers and will help protect the user's wrist against impact of a ball 7.

FIG. 6 illustrates use of the headwear 1 as a cap with the web member 31 serving as a liner for the crown 11. FIGS. 1 and 4 illustrate use of the headwear 1 as a glove means wherein the left hand 2 of a user is inserted between the web member 31 and the top of the crown 11. FIG. 4 shows the hand 2 inserted below strap member 21L and 21R. It is to be understood that if the opening 27 is large enough and/or the hand 2 is small enough, the hand 2 could be inserted above the strap members through the opening 27.

Modifications may be made in the specific construction shown without departing from the spirit and scope of the invention.

What is claimed is:

1. A baseball cap or the like comprising a body having a crown to fit on the head of a person wearing the cap, said body being formed of flexible material and having a substantially circumferential rim band defining the bottom of the crown and also defining a first opening for receiving said head, the back of said body having headsize adjusting means for adjusting the headsize of said first opening including overlapping strap members forming substantially coplanar extensions of said band and including a second opening in said crown at the back thereof and above the overlapping strap members, and a large flexible web extending transversely across the full cross sectional area of the crown adjacent the transverse level of the band and having a peripheral connecting portion substantially coextensive with the band and overlapping said band and secured to said band to securely connect the web to the body, said web being separate from the crown except for its connection to the band to provide a hand space between the web and the crown that includes substantially the full volume of the crown, said web being separate from the crown in the vicinity of the strap members and said second opening and such separation providing a third opening into said hand space located adjacent the transverse level of the band, said third opening and said hand space being reachable by a hand extending through each of the first and second openings, said web serving as a cover for a hand in said hand space to provide a glove means for such hand.

2. A cap as set forth in claim 1 wherein said web has a padded heel portion located below and spaced from said overlapping strap members and extending out of and below the plane of said first opening and overlapping the wrist of a hand inserted into said space through said third opening.

* * * * *